US006261670B1

(12) United States Patent
Hakomori et al.

(10) Patent No.: US 6,261,670 B1
(45) Date of Patent: Jul. 17, 2001

(54) HOT MELT INK TRANSFER RECORDING SHEET AND PROCESS FOR PRODUCING SAME

(75) Inventors: Masakazu Hakomori, Tokyo; Toru Nakai, Souka; Shuichi Maeda, Tokyo, all of (JP)

(73) Assignee: OJI Paper Co., Ltd., Tokyo (JP)

( * ) Notice: Subject to any disclaimer, the term of this patent is extended or adjusted under 35 U.S.C. 154(b) by 0 days.

(21) Appl. No.: 09/332,878

(22) Filed: Jun. 15, 1999

(30) Foreign Application Priority Data

Jun. 16, 1998 (JP) ..... 10-168434
May 25, 1999 (JP) ..... 11-145237

(51) Int. Cl.[7] ..... B41M 5/035; B41M 5/38
(52) U.S. Cl. ..... 428/195; 427/146; 428/304.4
(58) Field of Search ..... 428/195, 207, 428/304.4, 913, 914; 427/146

(56) References Cited

U.S. PATENT DOCUMENTS 5,521,626 5/1996 Tanaka et al. ..... 347/183
5,631,076 5/1997 Hakomori et al. ..... 428/304.4

FOREIGN PATENT DOCUMENTS 0 728 593 A1 8/1996 (EP) .
64-27996 1/1989 (JP) .
2-41287 2/1990 (JP) .
2-89690 3/1990 (JP) .
7-228065 8/1995 (JP) .
7-309074 11/1995 (JP) .
8-282137 10/1996 (JP) .
8-286409 11/1996 (JP) .
9-315021 12/1997 (JP) .
9-323485 12/1997 (JP) .

*Primary Examiner*—Bruce H. Hess
(74) *Attorney, Agent, or Firm*—Arent Fox Kintner Plotkin & Kahn, PLLC

(57) ABSTRACT

A hot melt ink transfer recording sheet capable of accurately recording ink images having high color density, color gradation reproducibility, dot reproducibility without shear of printed ink dots, has a porous ink-receiving layer formed on a substrate sheet, including a water-dispersible resin and having an average pore size of pores distributed in the surface portion thereof of 0.5 to 30 $\mu$m, an apparent density of 0.4 to 0.9 g/cm$^3$ and a compressive thickness reduction of 10 $\mu$m or less upon applying a compressive pressure of 1.0 kg/cm$^2$ thereto in the thickeness direction thereof.

7 Claims, No Drawings

HOT MELT INK TRANSFER RECORDING SHEET AND PROCESS FOR PRODUCING SAME

BACKGROUND OF THE INVENTION

1. Field of the Invention

The present invention relates to a hot melt ink transfer recording sheet and a process for producing the same. More particularly, the present invention relates to a hot melt ink transfer recording sheet which exhibits a high resistance to degradation of appearance, for example, caving formation of indents in the form of spots or stripes of the recording sheet, and thus is appropriate for hot melt ink thermal transfer printers in which the recording sheet is brought into contact with a thermal head of the printer through a hot melt ink ribbon under a high contact pressure; which can accurately receive a plurality of differently colored images at the desired recording positions without deviating the positions of the different coloring ink dots, and thus is useful for multi-color printing systems in which a plurality of different colored images are repeatedly transferred from the coloring ink ribbons; and which can record thereon colored images having excellent color density, a high gradation reproducibility and a superior dot reproducibility, and a process for producing the same.

2. Description of the Related Art

It is well known that a hot melt ink thermal transfer recording system using a hot melt ink transfer recording sheet and a thermal head of a thermal transfer printer has a simple mechanism and can be easily maintained, and thus is widely utilized in the printers for word processors and the printers for labels. In the hot melt ink thermal recording system, woodfree paper sheets have been mainly employed as the hot melt ink recording sheets. However, in the recent trend, full colored images with a high quality have been strongly in demand in ink jet recording system, dye-sublimation transfer recording system, laser recording system, etc.

There have been various attempts for full colored image-printing in the hot melt ink thermal transfer recording system. With respect to the printer, the conventional system in which a desired gradation of the full colored images is attained without changing the size of the transferred ink dots is replaced by a newly developed system in which a printer capable of varying the size of the unit dots, namely, a variable dot printer, is used. For example, the G6800-40 Printer made by MITSUBISHI DENKI is of the variable dot type. Also, the hot melt ink thermal transfer printer requires that the hot melt ink transfer recording sheet has such an important property that, in a full color recording with a wide range of applied printing energy from a low level to a high level, the hot melt-transferred ink dot forms can be accurately reproduced on the recording sheet, namely the dot reproducibility is high, and the ink can be transferred in a sufficient amount from the ink ribbon to the recording sheet, namely the color density of the recorded ink images is high.

In view of the above-mentioned technical background, the hot melt ink transfer recording sheet must be appropriate to the above-mentioned specific performance of the printer. For example, when a non-coated paper sheet for usual printing is used in the variable dot type hot melt ink transfer printer, the transferred ink images may have an unsatisfactory color density which may be derived from the low thermal insulating property of the non-coated paper sheet, and an insufficient dot-reproducibility which may be due to a low cushioning property of the non-coated paper sheet. Also, when the recording surface of the non-coated paper sheet is rough, the colored images may have no-ink-printed spots. These phenomena cause the dot-reproducibility to be poor. In addition to the reduction in the color density of the recorded ink images due to the poor dot-reproducibility, a further reduction in the color density of the recorded ink images may occur due to a low ink-absorption of the hot melt ink-receiving layer.

As an attempt to solve the above-mentioned problems, Japanese Unexamined Patent Publications No. 2-89,690 and No. 64-27,996 disclose an undercoat layer formed on a surface of the substrate sheet and comprising hollow solid particles. The resultant hot melt ink transfer recording sheet was, however, unsatisfactory in the cushioning property and heat insulating property enhancing effect thereof. Also, the recording sheets of the Japanese publications were disadvantageous in the following items. Namely, when the hollow solid particles are soluble in an organic solvent contained in a coating liquid for the ink-receiving layer, it is necessary that the hollow solid particles are bound with a binder comprising a specific polymeric material having a high resistance to the organic solvent or that an additional polymeric material layer having a high resistance to the organic solvent is formed on the undercoat layer containing the hollow solid particles, and thus the production of the recording sheet is complicated.

As another attempt to solve the afore-mentioned problems, Japanese Unexamined Patent Publication No. 2-41,287 discloses a recording sheet prepared by forming a resin layer comprising a water-soluble component, which can elute into water, on a substrate sheet comprising, as a principal component, a plastic resin; elution-removing the water-soluble component from the resin layer to form fine pores in the resin layer and to thereby enhance the ink-absorption capacity of the resultant hot melt ink transfer recording sheet. This attempt was, however, not fully successful because the maximum color density of the ink images recorded on the recording sheet was unsatisfactory, or the gloss of the printed ink images was insufficient, and thus the resultant recording sheet does not fully meet with the requirement for the qualities of the hot melt ink transfer recording sheet. Also, this type of the recording sheet is disadvantageous in that the substrate sheet thereof comprises, as a principal component, a plastic resin, and thus the recording sheet is difficult to recycle after use.

The conventional printers, in which the size of the image dot is not variable and a conventional type of dot are used, include a type of printer in which, when a thermal head of the printer is brought into contact with a recording surface of a recording sheet through an ink ribbon, the contact pressure of the thermal head is designed to be high, to make sure the transfer of the imagewise ink dots from the ink ribbon to the recording sheet surface and to thereby meet with the requirements for the good dot reproducibility, the high color-gradation reproducibility and the high color density of the recorded images. This type of printer includes a microdry-type printer, for example, the printers available under the trademark of PRINTER MD-1000, MD-1300 and MD-2000J, from ALPS DENKI K.K. The microdry type printers are advantageous in that the contact pressure of the ink ribbon with the recording sheet surface in the ink dot-transferring procedure is high, and thus the recording sheet does not need a high cushioning property and a high thermal insulating property to obtain a high quality of recorded ink images, and thus are definitely distinguished from the variable dot type printers. The contact pressure of the thermal head of the microdry type printer with the ink ribbon is assumed to be several tens kg/cm$^2$, while the contact pressure in the variable dot type printer is assumed to be several kg/cm$^2$. Also, currently, a new type of hot melt ink transfer printer has been developed by modifying the variable dot type printer so that an advantage that the contact pressure of the thermal head of the printer with the hot melt ink transfer recording sheet, through the ink transfer ribbon, is imparted to the variable dot type printer. In this type of printer, a very high quality of full colored ink images has a very good dot reproducibility over the low to middle color density range and a very high color density of the images over the high color density range. This type of printer includes, for example, a printer available under the trademark of PRINTER MD-5000, from ALPS DENKI K.K.

Usually, woodfree paper sheets or specific coated paper sheets comprising a substrate paper sheet and a hot melt ink-receiving layer formed on the substrate paper sheet and containing a certain type of pigment are used as hot melt ink transfer recording sheets for the printers which employ a high contact pressure of the thermal head. In this case, the transferring property of the hot melt ink to the recording sheet is not always sufficient in the recorded images in the low to middle color density range, and thus the above-mentioned conventional recording sheets cannot fully meet with the industrial demands which require the high quality of ink images. Also, since the contact pressure of the thermal head is high, the substrate sheet of the recording sheet is elongated by the first ink dot transfer procedure in the direction in which the thermal head scans, and thus due to the dimensional changes of the recording sheet, the second and later transferred ink dots cannot be accurately superposed on the first transfered ink dots. Therefore, the resultant colored images formed from a plurality of single colored ink images superposed on one another may have an unsatisfactory accuracy and differently colored tone.

Further, Japanese Unexamined Patent Publications No. 7-309,074 and No. 8-282,137 discloses a hot melt ink transfer recording sheet having a porous ink-receiving layer formed on a surface of a substrate sheet from a bubbled resin coating liquid. This type of the recording sheet is, however, disadvantageous in that, when the recording sheet is used in the printer in which a high contact pressure of the thermal head is applied to the recording sheet, the image-transferred portions of the recording sheet are indented by the high contact pressure of the thermal head, and thus the appearance of the recorded sheet is degraded.

SUMMARY OF THE INVENTION

An object of the present invention is to provide a hot melt ink transfer recording sheet appropriate for a hot melt ink transfer printer using a thermal head, particularly which is brought into contact with a surface of the recording sheet through an ink ribbon under a high contact pressure, and capable of recording thereon ink images transferred from the ink ribbon, without forming indents or stripes in the ink-transferred image portions of the recording sheet surface so as to not degrade the appearance of the recording sheet, and a process for producing the same.

Another object of the present invention is to provide a hot melt ink transfer recording sheet useful for a hot melt ink transfer printer in which a plurality of different coloring ink dots are accurately superposed on one another to form full colored images, substantially without deviating the positions of different transferred coloring ink dots from the target positions thereof, and a process for producing the same.

A further object of the present invention is to provide a hot melt ink transfer recording sheet capable of recording thereon hot melt ink images at a high color density with excellent color gradation reproducibility with superior dot reproducibility, and a process for producing the same.

The above-mentioned objects can be attained by the hot melt ink transfer recording sheet of the present invention and the process of the present invention for producing the same.

The hot melt ink transfer recording sheet of the present invention comprises:

a substrate sheet; and a porous ink-receiving layer formed on at least one surface of the substrate sheet by coating a resin-containing coating liquid comprising, as a principal component, a water-dispersible resin, the porous ink-receiving layer having an average pore size of the pores distributed in the surface portion thereof of 0.5 to 30 $\mu$m, an apparent density of 0.4 to 0.9 g/cm$^3$, and a compressive thickness reduction thereof of 10 $\mu$m or less upon applying a compressive pressure of 1.0 kg/cm$^2$ to the porous ink-receiving layer surface in the direction of the thickness of the porous ink-receiving layer.

In the hot melt ink transfer recording sheet of the present invention, preferably the apparent density of the porous ink-receiving layer is controlled to a level of from 0.4 to 0.9 g/cm$^3$ by applying a pressure surface treatment to the hot melt ink transfer recording sheet.

In the hot melt ink transfer recording sheet of the present invention, preferably an elongation of the melt ink transfer recording sheet in the cross direction thereof upon immersing it in water for 20 minutes in accordance with J. TAPPI No. 27 is 2.5% or less.

In the hot melt ink transfer recording sheet of the present invention, the substrate sheet preferably comprises a paper sheet comprising, as a principal component, cellulose.

In the hot melt ink transfer recording sheet of the present invention, preferably the water-dispersible resin for the porous ink-receiving layer comprises at least one member selected from water-dispersible polyurethane, urethane-acrylate ester copolymer, styrene-butadiene copolymer, acrylonitrile-butadiene copolymer, methyl methacrylate-butadiene copolymer, styrene-acrylate ester copolymer, polyacrylate ester, polymethacrylate ester, polyvinyl acetate, vinyl chloride-vinyl acetate copolymer, ethylene-vinyl acetate and polyvinylidene chloride resins.

The process of the present invention for producing a hot melt ink transfer recording sheet comprises mechanically agitating a coating liquid containing a polymeric material to an extent such that a large number of fine air bubbles independent from each other are introduced into the coating liquid in a bubbling ratio in volume of the bubbled coating liquid to the non-bubbled coating liquid of 1.1 or more but less than 2.5;

coating at least one surface of a substrate sheet with the bubbled coating liquid; and drying the coated bubbled coating liquid layer, to thereby form a porous ink-receiving layer having an average pore size of 0.5 to 30 $\mu$m of the pores distributed in the surface portion of the porous ink-receiving layer, an apparent density of 0.4 to 0.9 g/cm$^3$, and a compressive thickness reduction of 10 $\mu$m or less upon applying a compressive pressure of 1.0 kg/cm$^2$ onto the porous ink-receiving layer surface in the direction of the thickness of the porous ink-receiving layer.

The another process of the present invention for producing a hot melt ink transfer recording sheet comprises, mechanically agitating a coating liquid containing a polymeric material to an extent such that a large number of fine air bubbles independent from each other are introduced into the coating liquid in a bubbling ratio in volume of the bubbled coating liquid to the non-bubbled coating liquid of 2.5 to 6.0;

coating at least one surface of a substrate sheet with the bubbled coating liquid;

drying the coated bubbled coating liquid layer; and applying a pressure surface treatment to the porous ink-receiving layer surface, to thereby form a porous ink-receiving layer having an average pore size of 0.5 to 30 $\mu$m of the pores distributed in the surface portion of the porous ink-receiving layer, an apparent density of 0.4 to 0.9 g/cm$^3$, and a compressive thickness reduction of 10 $\mu$m or less upon applying a compressive pressure of 1.0 kg/cm$^2$ onto the porous ink-receiving layer surface in the direction of the thickness of the porous ink-receiving layer.

DESCRIPTION OF THE PREFERRED EMBODIMENTS

The inventors of the present invention have made extensive research into the hot melt ink transfer recording sheet which can attain the above-mentioned objects. As a result, it has been found that when a hot melt ink transfer recording sheet having a porous ink-receiving layer formed, on a substrate sheet, from a coating liquid containing, as a principal component, a water-dispersible resin and having a specific pore size of the pores distributed in the surface portion of the porous ink-receiving layer and a specific apparent density of the porous ink-receiving layer, is employed for a hot melt ink transfer printer, and even when a thermal head of the printer is brought into imagewise contact with the recording sheet through an ink ribbon under pressure, degradation of the appearance of the printed recording sheet due to formation of indents or stripes in the ink-transferred portions of the recording sheet under a high contact pressure of the thermal head, can be prevented or restricted, and the resultant colored ink images have a high color density, an excellent color gradation reproducibility and a superior dot reproducibility. Also, it has been found, by the inventors of the present invention, that when the hot melt ink transfer recording sheet having a substrate sheet comprising a cellulose paper sheet and exhibiting a specific elongation generated upon being immersed in water in the cross (transverse) direction of the recording sheet is employed for a full color printing system in which a plurality of different coloring ink dots are superposed on one another to form a desired colored images on the recording sheet, the different coloring ink dots can be accurately superposed on one another and the deviation of the superposed ink dots from the desired regular positions of the ink dots is small. The present invention was completed on the basis of the above-mentioned findings.

In the hot melt ink transfer recording sheet of the present invention, the porous ink-receiving layer formed on the substrate sheet comprises, as a principal component, a water-dispersible resin and optionally a pigment. The porous ink-receiving layer is formed by coating at least one surface of the substrate sheet with a bubbled coating liquid, prepared by mechanically bubbling an aqueous dispersion containing the water-dispersible resin and optionally the pigment, to form a plurality of fine air bubbles distributed in the aqueous dispersion, and by drying the resultant layer of the bubbled coating liquid on the substrate sheet.

The water-dispersible resins usable for the porous ink-receiving layer of the recording sheet of the present invention includes polymers and oligomers which have hydrophilic functional groups attached to the molecular chain skeletons thereof or which are in the form of a mixture with a surfactant, for example, an emulsifying agent used in the preparation of the polymers or oligomers. The polymers and oligomers can be stably dispersed in an aqueous medium to form an aqueous emulsion or an aqueous colloidal dispersion (microemulsion). The water-dispersible resin usable for the present invention preferably comprises at least one member selected from polyurethane resins, urethaneacrylate ester copolymer resins, styrene-butadiene copolymer resins (SBR latices), acrylonitrile-butadiene copolymer resins (NBR latices), methyl methacrylatebutadiene copolymer resins (MBR latices), styreneacrylate ester copolymer resins, polyacrylate ester resins, polymethacrylate ester resins, polyvinyl acetate resins, vinyl chloride-vinyl acetate copolymer resins, ethylene-vinyl acetate resins and polyvinylidene chloride resins, which are dispersible in water, which resins are merely representative but not limited thereto.

The above-mentioned water-dispersible resins may be employed alone or in a mixture of two or more thereof.

In consideration of the specific properties required for the recording sheet and the type and specific performance of the printer, conventional aqueous polymeric materials are optionally employed in addition to the water-dispersible resin. Namely, one or more of the aqueous polymeric materials as shown below can be employed together with the water-dispersible resins. For example, the aqueous polymeric materials are preferably selected from water-soluble polymers for example, various types of polyvinyl alcohols different in molecular weight and/or degree of saponification from each other, derivatives of the polyvinyl alcohols, for example, carboxy-modified polyvinyl alcohols and silyl-modified polyvinyl alcohols, starches and derivatives thereof (for example, dextrin and carboxymethyl starch), processed starches, for example, oxidized starches, cellulose derivatives, for example, methoxycellulose, carboxymethyl cellulose, methylcellulose and ethylcellulose and polyethylene glycols. The aqueous polymeric materials may include hide glue, casein, soybean protein, glatin and sodium aluginate.

In the present invention, the pigment usable for the porous ink-receiving layer preferably contains at least one member selected from inorganic pigments, for example, zinc oxide, titanium oxide, calcium carbonate, silicic acid, silicate salts, clay, talc, mica, calcined clay, aluminum hydroxide, barium sulfate, lithopone and colloidal silica; plastic resin pigments, for example, polystyrene, polyethylene, polypropylene, epoxy polymer, and styrene-acrylate ester copolymer pigments which may be in the form of true spheres, hollow particles, half sphere-shaped particles or confetti-shaped particles; heat-expansible hollow plastic particles containing, in the hollow spaces thereof, a gas capable of expanding upon heating, thus of causing the hollow plastic particles per se to be expanded upon heating; starch particles and cellulose particles. The pigments usable for the present invention are not limited to those mentioned above. Among the above-mentioned pigments, the fine silica particles and the colloidal silica particles can restrict the blocking of the porous ink-receiving layer even when they are used in a small amount, and thus are preferred in the present invention. The pigments can be present alone or in a mixture of two or more thereof in the porous ink-receiving layer.

As it can be assumed from the structure, the resin coating strength of the porous ink-receiving layer of the recording sheet of the present invention is not always high. The resin coating strength further decreases with addition of the pigment to the porous ink-receiving layer, and the reduced resin coating strength causes the transferred ink images on the porous ink-receiving layer to be peeled off therefrom. Accordingly, in the case where the porous ink-receiving layer is formed from a coating liquid containing the pigment added to the water-dispersible resin, the amount of the pigment should be appropriately established in consideration of the general quality required for the recording sheet.

The coating liquid containing the water-dispersible resin and optionally the pigment is further optionally added with an additive comprising at least one member selected from conventional viscosity-regulating agents, dispersing agents, dyes, water-resistance-enhancing agents, lubricants and plasticizers, before and/or after the air-bubbling procedure.

The porous ink-receiving layer is preferably formed in an amount of 2 g/m$^2$ or more on at least one surface of the substrate sheet. There is no upper limit to the coating amount of the porous ink-receiving layer. Generally, the air bubble-containing liquid having a low bubbling ratio (a ratio of a volume of a coating liquid after bubbling to a volume of the coating liquid before bubbling) has a smaller volume than that of a bubbled coating liquid having a high bubbling ratio and the same weight as that of the bubbled coating liquid having the low bubbling ratio, and thus exhibits a lower surface covering property than that of the bubbled coating liquid having the high bubbling ratio. When the coating amount of the porous ink-receiving layer is less than 2 g/m$^2$, it is probably difficult to fully smooth the surface of the substrate sheet having a certain surface roughness and thus a hot melt ink transfer recording sheet having a sufficient surface smoothness cannot be obtained. Accordingly, even when a printer in which a thermal head is brought into contact with the porous ink-receiving layer through an ink ribbon under a high contact pressure, is employed, the transfer of the ink in a low to middle color density range may not be satisfactorily effected and thus ink images having high quality may not be recorded. While there is no upper limited to the amount of the porous ink-receiving layer, if the thickness of the porous ink-receiving layer is too large, an economical disadvantage may occur. Therefore, the amount of the porous ink-receiving layer is preferably 20 g/cm$^2$ or less.

In the hot melt ink transfer recording sheet of the present invention, it is assumed that the mechanism by which the excellent hot melt ink-transferring property is realized is governed by the constitutions and physical properties, for example, compression properties, of the porous ink-receiving layer and the hot melt ink transfer recording sheet. In the constitutions, the porous ink-receiving layer formed on the substrate sheet has a plurality of fine pores distributed in the surface portion thereof, and thus exhibits an excellent absorption capacity of the hot melt ink due to the capillarity thereof. Also, since the plurality of pores contained in the porous ink-receiving layer are connected to each other to form interconnected cells, the hot melt ink can easily penetrate into the porous ink-receiving layer through the interconnected cells, and thus the hot melt ink transfer recording sheet of the present invention exhibit a high ink absorption rate and capacity.

In the hot melt ink transfer recording sheet of the present invention, the ink absorption rate and capacity of the porous ink-receiving layer are variable in response to the size of the pores distributed in the surface portion of the porous ink-receiving layer. Namely, for the purpose of forming clear ink images on the hot melt ink transfer recording sheet, by transferring the hot melt ink to the porous ink-receiving layer, preferably the pores located in the surface portion of the porous ink-receiving layer have an average pore size of 0.5 to 30 $\mu$m, more preferably 1.0 to 20 $\mu$m, still more preferably 1.0 to 5.0 $\mu$m.

The size of the pores distributed in the surface portion of the porous ink-receiving layer controls the capacity of the porous ink-receiving layer for catching and collecting the hot melt ink applied to the porous ink-receiving layer. The smaller the pore size, the higher the hot melt ink-catching and collecting capacity of the porous ink-receiving layer. However, when the average pore size is less than 0.5 $\mu$m, the ink-absorption capacity of the resultant porous ink-receiving layer may be unsatisfactory. Also, when the average pore size is more than 30 $\mu$m and thus is too large, the transferred ink is embedded within the pores and thus the transferred ink may not exhibit a desired color density. The size or diameter of the pores in the porous ink-receiving layer can be measured by using an optical microscope or a scanning electron microscope and an image analyzing apparatus.

The apparatus for forming and dispersing air bubbles in a water-dispersible resin-containing liquid includes frothing machines for confectionery having a plurality of rotary wings, homomixers which are generally utilized for emulsification and dispersion, and batch type agitators, for example, Caules dissolver. In a continuous production in an industrial scale, it is preferred that a mixture of a resin-containing liquid is continuously introduced together with air into a closed system and mechanically agitated in the closed system to froth the resin-containing liquid with fine air bubbles. For example, a slit-provided multiple cylinder type continuous frothing machine (which has a multiple cylinder type stator having a slit formed on the side face thereof and a cylinder type rotor having a slit formed on the side face thereof similar to the slit of the stator and in which the rotor is inserted into a gap of the stator, the rotor is rotated at a high speed, and a resin-containing liquid and air are introduced into the frothing machine and are agitated while passing through the slit to froth the resin-containing liquid with fine air bubbles) made by Gaston County Co., and a double cylinder type continuous frothing machine (which has a rotor attached with a pin and an outer cylinder attached with a pin, and in which the rotor is rotated at a high speed, to agitate a resin-containing liquid and air introduced into between the rotor and the outer cylinder and to froth the resin containing liquid with fine air bubbles), made by AIKOSHA SEISAKUSHO, STOKE CO., etc., can be used. These frothing machines can be used for producing the air bubble- and resin containing liquid without difficulty. There is no limitation to the type of the frothing machines usable for the present invention.

In the utilization of the above-mentioned frothing machines, when a batch type agitation apparatus is used, the size of the air bubbles dispersed in the resin-containing liquid can be controlled by appropriately adjusting the rotating rate of the rotor and rotation-continuation time in consideration of the composition and properties of the resin-containing liquid, for example, the type and content of surfactant, the viscosity of the resin-containing liquid, etc. The bubbling ratio can be controlled in consideration of the above-mentioned factors.

When a continuous frothing machine is used, the size of the air bubbles in the resin-containing liquid can be controlled by adjusting the rotation rate of the rotor and the resident time of the resin-containing liquid and air in the frothing machine (agitation time), in consideration of the compositions and properties of the resin-containing liquid, for example, the type and content of surfactant and viscosity of the resin-containing liquid. For example, in the case where the mixture of the resin-containing liquid and air is agitated at a fixed rotation rate and the ratio of the amount of the resin-containing liquid to the amount of air fed into the frothing machine is fixed, the smaller the total amount of the resin-containing liquid and air, and the longer the agitating time of the frothing machine applied to the resin-containing liquid and air, the smaller the size of the resultant air bubbles. Also, the bubbling ratio can be controlled by adjusting the ratio of the resin-containing liquid amount to the air amount introduced into the frothing machine.

The size of the pores distributed in the surface portion of the porous ink-receiving layer may be influenced by air bubble-forming condition, for the resin-containing liquid, the composition of the water-dispersible resin-containing liquid before dispersion treatment (namely the type and content of the resin and other components), and amount of solid components which is retained as a component directly influencing the thickness of the porous ink-receiving layer during the procedures from coating step to drying step, the bubbling ratio as mentioned above, the type of coating procedure, etc. The size of the pores distributed in the surface portion of the porous ink-receiving layer of the present invention is closely influenced by the size of the air bubbles dispersed in the frothed resin-containing coating liquid. There is no limitation to the air bubble-containing conditions of the water-dispersible resin-containing coating liquid. Generally, the size of the pores distributed in the surface portion of the coated and dried porous ink-receiving layer can be made smaller by making the size of the air bubbles contained in the resin-containing coating liquid smaller. Therefore, the air bubbles are preferably dispersed in an average diameter (size) of 0.5 to 30 $\mu$m, which is the same as the size of the pores located in the surface portion of the porous ink-receiving layer, in the resin containing coating liquid. The average diameter size of the air bubbles is more preferably 1.0 to 20 $\mu$m, still more preferably 1.0 to 5.0 $\mu$m. The size of the air bubbles in the coating liquid can be determined by taking a photograph of the air bubble and resin-containing coating liquid, and subjecting the photograph to an image analyzing apparatus.

In the preparation of the bubbled, resin-containing coating liquid, when a derived air-bubble-containing condition cannot be obtained due to a insufficient mechanical agitation capacity of the coating liquid-preparation apparatus, or when the stability of the air bubbles formed in the resin-containing coating liquid must be enhanced, the above-mentioned problems may be solved by adding an additive for promoting air bubble formation, appropriately selected from wide scope of surface active materials, for example, foam-regulating agents, foam stabilizers and foaming agents, to the resin-containing coating liquid.

The surface active materials usable for solving the above-mentioned problems, are preferably selected from higher fatty acids, modified higher fatty acids and alkali metal salts and ammonium salts of higher fatty acids, which are advantageous in a bubbling-enhancing effect, bubble-dispersion-promoting effect and bubble-stability-improving effect for the resin-containing coating liquid. There is no limitation to the selection of the surface active materials. However, the surface active materials are preferably selected from those which do not cause the fluidity of the bubbled resin-containing coating liquid to be reduced or the coating processability of the bubbled resin-containing coating liquid to be degraded. The surface active materials usable as foam stabilizers or foaming agents are preferably employed in an amount of 30 parts by weight or less, more preferably 1 to 20 parts by weight per 100 parts by weight of the total solid content of the resin-containing coating liquid or per 100 parts by weight of the total solid resin and pigment content of the resin and pigment-containing coating liquid. When the amount of the surface active materials is more than 30 parts by weight, the air bubble formation-promoting effect of the surface active materials may be saturated and an economical disadvantage may occur.

In the case where the hot melt ink transfer recording sheet is brought into contact through an ink ribbon with a thermal head of a printer, especially a hot melt ink transfer printer in which the thermal head is operated under a high contact pressure with the recording sheet, it is very important that the average size of the pores distributed in the recording surface portion of the hot melt ink transfer recording sheet is controlled to an appropriate level and the apparent density of the porous ink-receiving layer is optimized, to prevent or restrict the degradation of appearance, for example, indent-formation or stripe-formation in the image-recording surface, to enhance the color density of the recorded ink images, and to obtain hot melt ink-transferred images having an excellent color gradation-reproducibility and a superior dot-reproducibility. Namely, to prevent or restrict the degradation of the appearance due to the formation of indents or stripes on the image-recording surface, the deformation of the porous ink-receiving layer under pressure due to the contact pressure applied by the thermal head must be prevented or restricted. For this purpose, the bubbling ratio of the resin-containing coating liquid must be optimized, and thus the average size (diameter) of the pores distributed in the surface portion of the coated and dried porous ink-receiving layer must be maintained at an appropriate level and the apparent density of the porous ink-receiving layer must be appropriately optimized. A porous ink-receiving layer formed from a bubbled resin-containing coating liquid having a high bubbling ratio, exhibit a low apparent density and thus when a hot melt ink transfer printer (for example, printer MD-5000, MD-1000, MD-1300 or MD-2000J, made from ALPS DENKI K.K.) is used under a contact pressure of the thermal head of several tens kg/cm$^2$, for the low apparent density porous ink-receiving layer, the indents and strips are formed to an great extent on the porous ink-receiving layer and the appearance of the image-recorded recording sheet is degraded. Therefore, the apparent density of the porous ink-receiving layer is preferably controlled to 0.4 to 0.9 g/cm$^3$. To obtain the apparent density, the bubbling ratio of the bubbled resin-containing coating liquid is preferably controlled to 1.1 or more but less than 2.5. When the bubbled resin-containing coating liquid having the above-mentioned bubbling ratio is coated on the substrate sheet and is dried, the resultant coated sheet can be used as a hot melt ink transfer recording sheet for the printer.

To produce the porous ink-receiving layer having the above-mentioned apparent density, a bubbled resin-containing coating liquid having a bubbling ratio higher than that mentioned above is coated on a substrate sheet and the resultant coating liquid layer is coated to produce a precursory hot melt ink transfer recording sheet having a high apparent density of the porous ink-receiving layer, and a surface-passing treatment is applied to the precursory recording sheet to make the porous ink-receiving layer dense.

In this production process, preferably, a bubbled resin-containing coating liquid having a bubbling ratio of 2.5 to 6.0 is coated on a surface of the substrate sheet and dried, and then the resultant precursory hot melt ink transfer recording sheet is subjected to a surface-pressing treatment so as to adjusted the apparent density of the porous ink-receiving layer into a range of from 0.4 to 0.9 g/cm$^3$. More preferably, a bubbled resin-containing coating liquid having a bubbling ratio of 2.5 to 4.0 is coated on a substrate sheet surface, and dried, and then the resultant precursory hot melt ink transfer recording sheet is subjected to a surface-pressing treatment to adjust the apparent density of the porous ink-receiving layer into the range of from 0.4 to 0.9 g/cm$^3$.

When a resin-containing coating liquid having a bubbling ratio of less than 1.1, which is close to a non-bubbled resin-containing coating liquid, is coated on a substrate sheet surface and dried, and the resultant hot melt ink transfer recording sheet is surface-pressed to further increase the apparent density of the (porous) ink-receiving layer, to form an ink-receiving layer having an apparent density of more than 0.9 g/cm$^3$, the ink-receiving layer has an enhanced hardness and thus the deformation of the ink-receiving layer due to a high contact pressure of the thermal head and the degradation of the appearance can be prevented. However, the ink-receiving layer having an increased hardness exhibits a decreased hot melt ink-receiving capacity. Therefore, even if the pores located in the surface portion of the ink-receiving layer have an appropriate average pore size, a high color density of the transferred ink images cannot be obtained, and the color gradation reproducibility and the dot reproducibility are decreased. This the resultant recording sheet exhibit a degraded recording performance.

Also, when a bubbled resin-containing coating liquid having a bubbling ratio of more than 6.0 is coated on a substrate sheet and dried, the resultant porous ink-receiving layer of the hot melt ink transfer recording sheet has a high air bubble content, and thus the resin walls surrounding the air bubbles in the ink-receiving layer has a reduced thickness. Therefore, when a surface-pressing treatment is applied to the porous ink-receiving layer to adjust the apparent density of the porous ink-receiving layer into a range of from 0.4 to 0.9 g/cm$^3$, the porous structure of the porous ink-receiving layer per se is broken. Thus, while the degradation of the appearance can be prevented or restricted, the ink receiving layer may be partially peeled off during the printing procedure and non-colored spots may be formed in the colored images. The reasons for the disadvantageous phenomenon are assumed that since the surface-pressing treatment causes the inner structure of the porous ink-receiving layer is broken to reduce the strength of the porous ink-receiving layer, when ink images are transferred from the ink ribbon to the recording sheet surface superposed on the ribbon, and the ink ribbon is removed from the recording sheet surface, portions of the porous ink-receiving layer are removed together with the ink ribbon from the substrate sheet, and thus portions of the resultant ink images are lost, to form inkless spots.

When the porous ink-receiving layer is pressed under a pressure of 1.0 kg/cm$^2$, the compressive thickness reduction of the porous ink receiving layer in the direction of the thickness thereof is preferably controlled to a level of 10 $\mu$m or less, more preferably 8 $\mu$m or less. If the compressive thickness reduction is more than 10 $\mu$m, and when the hot melt ink transfer is employed under a high contact pressure of the thermal head, the undesirable indents and stripes are formed in the thermal head-contented areas of the recording sheet, and thus the appearance of the recording sheet is degraded.

The surface-pressing treatment of the method of the present invention for controlling the apparent density of the porous ink-receiving layer can be effected by a calendering treatment employing a super calender comprising a combination of a metallic roll with a plastic resin roll or a combination of a metallic roll with a cotton roll, or a machine calender comprising two or more metallic rolls, or a mirror-finished surface transfer casting procedure in which a bubbled resin-containing coating liquid is coated on a substrate sheet, and the resultant porous ink-receiving layer is brought, while the porous ink receiving layer is in a semi-dried state or a dried state, into contact with a mirror-finished casting surface, which may be in a heated or non-heated condition, under pressure, to transfer the mirror-finished surface from the casting surface to the porous ink-receiving layer surface.

The substrate sheet usable for the present invention is preferably formed from coated paper sheets or laminated paper sheets each comprising, as a principal component, cellulose. Also, the substrate sheet may be in the form of a woven fabric or nonwoven fabric. Further, porous synthetic resin films, for example, porous polyolefin films, porous polymethacrylate ester films, and foamed polypropylene films can be used for the substrate sheet. When a paper sheet or a coated paper sheet each comprising cellulose as a principal component, is used as a substrate sheet, the paper sheet or coated paper sheet preferably has a Bekk smoothness of 50 to 4,000 seconds, more preferably 70 to 500 seconds and/or an air permeability of 10 to 10,000 seconds, more preferably 15 to 1,000 seconds, determined in accordance with JAPAN TAPPI No. 5. The paper sheet and coated paper sheet comprising, as a principal component, cellulose are advantageous in that they can be recycled.

The measurement methods for Bekk smoothness and the air permeability, in accordance with JAPAN TAPPI No. 5, are as follows.

Instrument and Device

The measurement instrument has a measuring portion, an air compressor, a pressure-reducing valve, a filter, a regulator, a pressure-regulating valve, a water column-type air pressure regulator, an air inlet orifice for measurement, water column manometers, and scales.

Measuring Portion

There are two measuring portions: one for smoothness and one for air permeability.

Measuring Portion for Smoothness

The measuring portion for smoothness, which has the structure as shown in FIG. 5, consists of a measuring head made of an abrasion resistant and inflexible material and of a balance equipped with a rubber presser board. The rubber presser board and the balance press the test strip to the measuring head to measure smoothness.

Measuring Portion for Air Permeability

The measuring portion for air permeability has a structure identical with the measuring portion of the testing device B in JIS P 8117, Testing method of air permeability of paper and board.

Air Compressor, Pressure-reducing Valve, and Pressure-regulating Valve

The pressure of the air compressed to 5–7 kg/cm$^2$ with the air compressor is reduced to about 1 kg/cm$^2$ with the pressure-reducing valve, passes through the filter and is regulated to about 0.1 kg/cm$^2$ with the pressure-regulation valve.

Water Column-type Air Pressure Regulator, and Air Inlet Orifice for Measurement

The water column-type air pressure regulator consists of a water tank with an inner diameter of 100 mm and a height of 700 mm, and an air chamber having an opening at a point 500 mm below the water surface.

The air at a pressure of about 0.1 kg/cm$^2$ that passes into the air chamber is pressure-regulated to a water column of 500 mm, and passes through the air inlet orifice for measuring smoothness, and the air inlet orifice for measuring air permeability, to reach the measuring portion. The air inlet orifice for measurement is an inflexible capillary and the orifice used for measuring smoothness has an inner diameter of 0.3 mm and a length of 50 mm and that for measuring air permeability has an inner diameter of 0.4 mm and a length of 54 mm.

Water Column Manometer and Scale

There is a water column manometer outside of the water column-type air pressure regulator. The bottom of the water column manometer is connected to the bottom of the water tank, and the upper part is connected to the air inlet orifice for measurement and the measuring portion. The scale of a standard type testing instrument has a scale of 0–500 mm and scales indicating a Bekk smoothness of up to 3,000 seconds and a Gurly air permeability of up to 2,000 seconds. The indicated value of 250 mm of the water column manometer represents a Bekk smoothness of 100 seconds and a Gurly air permeability of 100 seconds. In addition to this standard type, there are testing devices for increased smoothness and for high air permeability.

Test Strip

The test strip used must be free of detergent, creases, and wrinkles. For each test, 10 strips of 60 square centimeters or more are prepared.

Test Procedure

The testing should be performed in an atmosphere conforming to the condition of JIS P 8111 (Pretreatment of test paper). The test procedure was performed in the following order:

Measurement of Smoothness

An air pressure-regulated to about 0.1 kg/cm$^2$ is fed into the water column-type pressure regulator.

The scale of the manometer is adjusted so that it points to 500 mm when the balance equipped with a rubber presser board is laid on the measuring head, and to the zero point when the balance equipped with a rubber presser board is removed.

The test strip is placed on the measuring head, with the measured side facing down, and a given pressure is added using a lever and the indicated value is read after the water column manometer stopped.

Measurement of Air Permeability

It is confirmed that the scale of the manometer points to a scale of 500 mm when the smooth rubber board on the surface is clamped, and to the zero point when the rubber board is removed.

The test strip is clamped to the measuring portion, and the indicated value is read after the water column manometer has stopped.

The measurement method of the elongation of the substrate sheet in the cross-direction in accordance with Japan TAPPI NO. 27 is as follows.

Method B

Instrument and Devices (1) Fenchel expansion testing instrument
  a Main body (see the figure)
  b Balance
  c Measurement range 0–10 mm
  c Precision 0.01 mm (minimum scale)
(2) Stopwatch
(3) Blotting paper Test Strip The test strip, selected from a test paper that was pretreated according to JIS P 8111, should be free of irregular weaves, bends, wrinkles etc. The strip is cut into strips measuring 15.0+/−0.2 mm in width and about 150 mm in length. Five or more test strips are prepared.

Test Procedure

Testing is performed in a room that conforms to the condition (4) in JIS P 8111 as follows:

(1) water preheated to 20+/−2° C. is fed into a water tank to a depth that can fully immerse the test strip.
(2) A distance between the grips is adjusted to 100 mm.
(3) The zero point of the dial gauge is adjusted by the zero point adjuster.
(4) A balance weighting about ¼ of the weight (g/m$^2$) of the sample is placed on the balance stage.

Note: When a balance other than the one defined was used, record to this effect in the report.

(5) Attach the test strip.
(6) Remove the stopper.
(7) Adjust the zero point of the dial gauge again by the zero point adjuster (fine tuning).
(8) Rotate the handle to raise the water tank to attain a depth in which the test strip can be fully immersed, and then fix the water tank with the fixing screw.
(9) Start the stopwatch. Perform (8) and (9) quickly.
(10) The immersion time is 5 minutes. The indicated value on the dial gauge is read up to a level of 0.01 mm. If needed, read the indicated value on the dial gauge at regular intervals, and continue measuring until the expansion has been stabilized.
(11) After the measurement is over, place the stopper and loosen the fixing screw while supporting the handle, and then rotate the handle to allow the water tank to descend.
(12) Remove the test strip, and wipe out the remaining water with blotting paper.

Note (4): The test is vulnerable to shaking and thereby should be performed at a place where shaking is minimal.

However, when the coated paper sheet or the laminated paper sheet comprising, as a principal component, cellulose is used as a substrate sheet for the present invention, and the resultant hot melt ink transfer recording sheet is subjected to a full colored image recording under high temperature and/or high humidity conditions, such a disadvantage in that a first coloring ink dots are not accurately superposed with second and other succeeding coloring ink dots and thus full colored images having a high accuracy and/or a desired color cannot be obtained, may occur. The reasons for the disadvantage are assumed that when the ink transfer is carried out by using a hot melt ink transfer printer in which the ink transfer is carried out under a high contact pressure of the thermal head, the ink-transfer from the ink ribbon to the recording sheet is effected under a condition like that the recording sheet is rubbed with the ink ribbon under the high contact pressure of the thermal head, the rubbed recording sheet is elongated in the first coloring ink dot-transferring operation in the scanning direction of the thermal head, the second and other succeeding coloring ink dot-transferring operations are applied to the elongated recording sheet, and thus the second or later transferred ink dots cannot be accurately superposed on the first transferred ink dots and are slightly shifted from the first ink dots.

In the paper sheet or coated paper sheet comprising, as a principal component, cellulose, the cellulose fibers are orientated along the flow axis of the paper machine, namely in a machine direction. A direction at right angles to the machine direction is referred to a cross direction. In a simple manner for determining the machine or cross direction of a paper sheet or coated paper sheet, a direction in which the stiffness of a paper sheet is lower than that in another direction at right angles to the direction, is the cross direction. For example, in a A4 size coated paper sheet, the machine direction thereof is a longitudinal direction and the cross direction thereof is a transverse direction. This type of paper sheet is generally referred to as a longitudinal paper sheet. Also, another type of paper sheet of which the machine direction is a transverse direction and the cross direction is a longitudinal direction is referred to a transverse paper sheet. The paper sheet or coated paper sheet comprising cellulose as a principal component elongates and shrinks in response to increase and decrease in humidity of the ambient atmosphere. Usually, the elongation and shrinkage of the sheet in the cross direction are ten times or more those of the sheet in the longitudinal direction along which the cellulose fibers are orientated.

When the paper sheet or coated paper sheet comprising as a principal component, cellulose, is used as a substrate sheet of the hot melt ink transfer recording sheet of the present invention, and the cellulose fibers in the substrate sheet are orientated in a direction at right angles to the scanning direction of the thermal head, it may occur that the recording sheet is rubbed with the thermal head in the cross direction of the substrate paper sheet in which the substrate paper sheet is easily elongated by rubbing under a high contact pressure, and thus the substrate sheet is elongated in the cross direction. This phenomenon may easily occur under high temperature and high humidity conditions under which a large amount of moisture is accumulated in the gaps between the cellulose fibers and thus the gaps between the cellulose fibers are expanded. However, when the cellulose fibers in the substrate sheet are orientated in a direction parallel to the scanning direction of the thermal head, the thermal head rubs the recording sheet in the machine direction of the substrate sheet, in which direction the dimension of the substrate sheet is stable, and thus the first coloring ink dots can be accurately superposed with second and succeeding ink dots and the resultant full colored ink images are sharp and exhibit a desired color.

Even in the case where the substrate sheet of the hot melt ink transfer recording sheet is formed from a paper sheet or a coated paper sheet, and the scanning direction of the thermal head is at right angles to the direction along which the cellulose fibers in the paper sheet are orientated, when the elongation of the substrate sheet in the cross-direction is 2.5% or less determined in accordance with J. TAPPI, No. 27, after immersing it in water at room temperature for 20 minutes, and thus the elongation of the paper sheet or coated paper sheet in the cross direction due to the change in humidity is low, no deviation of the coloring ink dots due to the elongation of the substrate sheet occurs.

To reduce the elongation of the paper sheet or coated paper sheet used as a substrate sheet for the hot melt ink transfer recording sheet in the cross direction, a method in which, when the paper sheet is produced by the paper-forming method, the ratio in speed of the jetted material slurry to the wire of the paper machine (JET/WIRE ratio) is made small to make the fiber orientation ratio (T/Y ratio) small, or a method in which, in the paper-forming method, the wet paper sheet is dried by a dryer in such a manner that an appropriate binding force established in response to the fiber orientation ratio is applied to the wet paper sheet after pressing by a press in the transverse direction of the paper sheet, is used, or a dry pulp or a mixture of a dry pulp with another pulp is used as a pulp forming the paper sheet, or a pulp having a low degree of beating or a mixture of the low beating degree pulp with another pulp is used. The above-mentioned specific paper-forming methods and the specific pulps are selected and utilized in response to the desired use of the target recording sheet.

There is no limitation to the type of the pulp to be used for the purpose of obtaining a paper sheet having a low elongation in water in the cross direction. For example, chemical pulps such as LBKP (hardwood bleached kraft pulps), NBKP (softwood bleached kraft pulps), LBSP (hardwood bleached sulfite pulps) and NBSP (softwood bleached sulfite pulps) and waste paper pulps can be used for the above-mentioned purpose. Also, the dry pulps of LBKP are advantageously utilized to restrict the elongation of the paper sheet in water.

A coating method for forming the porous ink-receiving layer, on at least one surface of the above-mentioned substrate sheet, may be selected from conventional coating methods, for example, mayer bar type, gravure roll type, knife type, reverse roll type, blade type, extruder type, gate roll type, 2 roll-size press type and cast type coating methods.

In the production of the hot melt ink transfer recording sheet of the present invention by coating the above-mentioned bubbled resin-containing coating liquid on a surface of the substrate sheet, and by drying the coated liquid layer, the resultant hot melt ink transfer recording sheet may be curled in such a manner that the porous ink-receiving layer comes inside or outside of the curled sheet during the coating, drying or winding procedure. In this case, when the hot melt ink transfer recording sheet having the porous ink-receiving layer is cut into desired dimensions, the resultant cut recording sheets having a desired dimensions are curled and are unsatisfactory in appearance, and cannot be smoothly fed into a printer or cause the recording sheets passing through the printer to be blocked, and thus exhibits a poor forwarding property in the printer.

To prevent the above-mentioned troubles due to the curling of the recording sheets, a curl-preventing layer may be coated or laminated on a back surface of the hot melt ink transfer recording sheet namely a surface opposite to the porous ink-receiving layer-formed surface of the substrate sheet. There is no limitation to the type, forming method, coating weight and laminate weight of the curl-preventing layer. These can be selected in consideration of the type and thickness of the substrate sheet, the properties, composition, bubbling ratio and coating weight of the porous ink-receiving layer and other features, to optimize the performance of the curl-preventing layer.

To control the curling property of the recording sheet, a pair of porous ink-receiving layers are advantageously formed on both the front and back surfaces of the substrate sheet with the same material composition, bubbling ratio and coating weight as each other. In this case, since good images can be recorded on the front and back surfaces of one recording sheet, this type of the recording sheet can be used in various uses and has a high economical advantages.

EXAMPLES

The present invention will be further illustrated by the following examples which are merely representative and are not intended to restrict the scope of the present invention in any way. In the examples and comparative examples, the term "part" means—part by solid weight—, unless indicated otherwise.

Example 1

An aqueous resin mixture having the following composition and a solid content of 31% by weight was prepared.

Aqueous resin mixture

| Component | Part |
|---|---|
| Resin: Water-dispersible polyurethane resin (trademark: ADEKABON-TITER HUX-381, made by ASAHI DENKA KOGYO K.K.) | 100 |
| Bubble stabilizer: Ammonism salt compound of higher fatty acid (trademark: F-1, made by DAINIHON INK KAGAKUKOGYO K.K) | 5 |
| Thickener: Carboxymethyl cellulose compound (trademark: AG Gum, made by DAIICHI KOGYOSEIYAKU K.K.) | 3 |

The aqueous resin mixture was subjected to a bubbling (frothing) treatment by using a continuous bubbling machine (trademark: TURBOWHIP TW-70, made by AIKOSHA SEISAKUSHO) and by agitating it together with air at a revolution rate of 1500 rpm to prepare a bubbled aqueous resin mixture having a bubbling ratio of 1.2.

Immediate after the bubbling treatment, the resultant bubbled resin-containing coating liquid was coated on a front surface of a substrate sheet consisting of a woodfree paper sheet (trademark: MARSHMALLOW, made by OJI PAPER CO.) having a basis weight of 104.7 g/m$^2$ by using an applicator bar, and dried to form a porous ink-receiving layer having a dry weight of 10 g/m$^2$.

Also, the back surface of the substrate sheet opposite to the front surface on which the porous ink-receiving layer was formed, was coated, with a curl-preventing coating liquid having the following composition and a solid content of 5% by solid weight, by using a mayer bar and dried to form a curl-preventing layer having a dry weight of 3 g/m$^2$.

Curl-preventing coating liquid

| Component | Part |
|---|---|
| Oxidized starch (trademark: OJI ACE-C, made by OJI CORNSTARCH K.K.) | 100 |
| Polyvinyl alcohol (trademark: PVA 117, made by KURARAY K.K.) | 20 |

The resultant coated paper sheet was cut into A4 size in such a manner that the cross direction of the substrate sheet was consistant with the transverse direction of the resultant A4 size sheet, to prepare A4 size hot melt ink transfer recording sheets. The recording sheet exhibited an elongation in water of 1.80% in the cross direction of the substrate sheet, determined by the test which will be explained hereinafter.

Example 2

A hot melt ink transfer recording sheet were produced by the same procedures as in Example 1 with the following exceptions.

The same aqueous resin mixture as in Example 1 was subjected to a bubbling treatment using the same continuous bubbling machine as in Example 1 by agitating the aqueous resin mixture together with air at a revolution rate of 1500 rpm to prepare a bubbled aqueous resin-containing coating liquid having a bubbling ratio of 2.4.

Immediate after the bubbling treatment, the bubbled coating liquid was coated on a front surface of a substrate sheet consisting of a synthetic paper sheet (trademark: YUPO FPG110, made by OJI YUKAGOSEISHI K.K.) having a thickness of 110 $\mu$m by using an applicator bar and dried to form a porous ink-receiving layer having a dry weight of 10 g/m$^2$. Also, a back surface opposite to the porous ink-receiving layer-coated surface of the substrate sheet was coated, with a curl-preventing coating liquid having the same composition as that in Example 1 and a solid content of 5% by weight, by using a mayer bar, and dried to form a curl-preventing layer having a dry weight of 5 g/m$^2$. The resultant hot melt ink transfer recording sheet was cut into A4 size in the same manner as in Example 1.

The A4 size hot melt ink transfer recording sheets exhibited an elongation in water of 0% in the cross direction of the substrate sheet.

Example 3

A hot melt ink transfer recording sheet were produced by the same procedures as in Example 1 with the following exceptions.

The same aqueous resin mixture as in Example 1 was subjected to a bubbling treatment using the same continuous bubbling machine as in Example 1 by agitating the aqueous resin mixture together with air at a revolution rate of 1500 rpm to prepare a bubbled aqueous resin-containing coating liquid having a bubbling ratio of 3.0.

Immediate after the bubbling treatment, the bubbled coating liquid was coated on a front surface of a substrate sheet consisting of a woodfree paper sheet (trademark: MARSHMALLOW, made by OJI PAPER CO.) having a basis weight of 104.7 g/m$^2$ by using an applicator bar and dried to form a porous ink-receiving layer having a dry weight at 10 g/m$^2$. Also, a back surface opposite to the porous ink-receiving layer-coated surface of the substrate sheet was coated by a curl-preventing coating liquid having the same composition as that in Example 1 and a solid content of 5% by weight by using a mayer bar, and dried to form a curl-preventing layer having a dry weight of 5 g/m$^2$.

The resultant hot melt ink transfer recording sheet was subjected to a surface-pressing treatment using a super calender (trademark: TEST CALENDER 45FR-150E2 type, made by KUMAGAYA RIKIKOGYO K.K.) comprising a metal roll and a cotton roll under a nip pressure of 30 kg/cm at a roll peripheral speed of 5 m/min in such a manner that the porous ink-receiving layer of the recording sheet came into contact with the periphery of the metal roll. The surface-pressed hot melt ink transfer recording sheet was cut into A4 size in such a manner that the cross direction of the substrate sheet of the recording sheet consisted with the transverse direction of the A4 size sheets.

The A4 size hot melt ink transfer recording sheets exhibited an elongation in water of 1.95% in the cross direction of the substrate sheet.

Example 4

The hot melt ink transfer recording sheet prepared by the same bubbled resin-containing coating liquid preparation procedure and the same coating procedures as in Example 3 was subjected to a surface-pressing treatment using the same super calender as in Example 3 under a nip pressure of 90 kg/cm at a roll periphery speed of 5 m/min in the same manner as in Example 3.

The surface-pressed hot melt ink transfer recording sheet was cut into an A4 size in such a manner the transverse direction of the A4 size sheet consisted of the cross direction of the substrate sheet of the recording sheet.

The hot melt ink transfer recording sheets exhibited an elongation in water of 1.95%.

Example 5

An aqueous resin mixture having the following composition and a solid content of 31% by weight was prepared.

Aqueous resin mixture

| Component | Part |
|---|---|
| Resin: Water-dispersible polyurethane resin (trademark: ADEKABON-TITER HUX-381, made by ASAHI DENKA KOGYO K.K.) | 100 |
| Bubble stabilizer: Ammonism salt compound of higher fatty acid (trademark: F-1, made by DAINIHON INK KAGAKUKOGYO K.K.) | 5 |
| Thickener: (Carboxymethyl-cellulose compound (trademark: AG Gum, made by DAIICHI KOGYOSEIYAKU K.K.) | 3 |
| Pigment: Clay (trademark: HT Clay, made by HISSAN SHOJI K.K.) | 10 |

The aqueous resin mixture was subjected to a bubbling (frothing) treatment by using the same continuous bubbling machine as in Example 1 and by agitating it together with air at a revolution rate of 1500 rpm to prepare a bubbled aqueous resin mixture having a bubbling ratio of 3.0.

Immediately after the bubbling treatment, the resultant bubbled resin-containing coating liquid was coated on a front surface of a substrate sheet consisting of a woodfree paper sheet (trademark: MARSHMALLOW, made by OJI PAPER CO.) having a basis weight of 104.7 g/m$^2$ by using an applicator bar, and dried to form a front porous ink-receiving layer having a dry weight of 10 g/m$^2$.

Also, the back surface of the substrate sheet opposite to the front surface on which the porous ink-receiving layer was formed, was coated with a coating liquid having the same composition as mentioned above by using an applicator bar and dried to form a back porous ink-receiving layer having a dry weight of 10 g/m$^2$. The resultant hot melt ink transfer recording sheet was subjected to a surface-pressing treatment using the same super calender as in Example 3 under a nip pressure of 35 kg/cm at a roll peripheral speed of 5 m/min in the same manner as in Example 1. The surface-pressed hot melt ink transfer recording sheet was cut into A4 size in such a manner that the cross direction of the substrate sheet of the recording sheet consisted with the transverse direction of the A4 size sheets.

The A4 size hot melt ink transfer recording sheets exhibited an elongation in water of 1.90% in the cross direction of the substrate sheet.

Example 6

An aqueous resin mixture having the following composition and a solid content of 31% by weight was prepared.

Aqueous resin mixture

| Component | Part |
|---|---|
| Resin: Water-dispersible acrylic resin (trademark: BONRONS-1320, made by MITSUI KAGAKU K.K.) | 100 |
| Bubble stabilizer: Ammonism salt compound of higher fatty acid (trademark: F-1, made by DAINIHON INK KAGAKUKOGYO K.K.) | 5 |
| Thickener: (Carboxymethyl-cellulose compound (trademark: AG Gum, made by DAIICHI KOGYOSEIYAKU K.K.) | 3 |

The aqueous resin mixture was subjected to a bubbling (frothing) treatment by using the same continuous bubbling machine as in Example 1 and by agitating it together with air at a revolution rate of 1500 rpm to prepare a bubbled aqueous resin mixture having a bubbling ratio of 6.0.

Immediate after the bubbling treatment, the resultant bubbled resin-containing coating liquid was coated on a front surface of a substrate sheet consisting of a woodfree paper sheet (trademark: MARSHMALLOW, made by OJI PAPER CO.) having a basis weight of 104.7 g/m$^2$ by using an applicator bar, and dried to form a porous ink-receiving layer having a dry weight of 10 g/m$^2$.

Also, the back surface of the substrate sheet opposite to the front surface on which the porous ink-receiving layer was formed, was coated with the same curl-preventing coating liquid as in Example 1 having a solid content of 5% by using a mayer bar and dried to form a curl-preventing layer having a dry weight of 10 g/m$^2$. The resultant hot melt ink transfer recording sheet was subjected to a surface-pressing treatment using the same super calender as in Example 3 under a nip pressure of 25 kg/cm at a roll periphery speed of 5 m/min in the same manner as in Example 1. The surface-pressed hot melt ink transfer recording sheet was cut into an A4 size in such a manner that the cross direction of the substrate sheet of the recording sheet was consistant with the transverse direction of the A4 size sheets.

The A4 size hot melt ink transfer recording sheets exhibited an elongation in water of 2.0% in the cross direction of the substrate sheet.

Example 7

A hot melt ink transfer recording sheet was produced by the same procedure as in Example 3 with the following exceptions.

A paper sheet for the substrate sheet was produced by the following procedure.

Production of Paper Sheet for Substrate Sheet

An LBKP having a Canadian Standard Freeness (CSF) of 500 ml was employed in an amount 100 parts of which 40 parts by solid weight were dry pulp. The LBKP was suspended in an amount of 100 parts together with 10 parts of precipitated calcium carbonate (trademark: TP121, made by OKUTAMA KOGYO K.K.), 0.08 part of a inner sizing agent consisting of an alkenylsuccinic anhydride (trademark: FINEBRAN 81, made by NATIONAL STARCH AND CHEMICAL CO.) and 0.5 part of cationic starch (trademark: ACEK, made by OJI CORNSTARCH K.K.), in water to prepare an aqueous pulp slurry.

The aqueous pulp slurry was subjected to a paper-forming procedure using a long wire paper machine, in which procedure, the wire speed and the Jet/Wire ratio in the paper-forming step were controlled so that the resultant paper sheet exhibit a fiber orientation ratio (T/Y ratio) of 1.05, and in the drying step, a binding force was applied to the paper sheet in a direction at right angles to the paper-forming direction. The resultant paper sheet had a moisture content of 5% by weight and a basis weight of 120 g/m$^2$.

The resultant hot melt ink transfer recording sheet exhibited an elongation in water of 1.35% in the cross direction of the substrate sheet.

Example 8

A hot melt ink transfer recording sheet was produced by the same procedures as in Example 3, except that a substrate sheet consisting of a woodfree paper sheet (trademark: MARSHMALLOW, made by OJI PAPER CO.) and having a basis weight of 157 g/m$^2$ was used.

The resultant hot melt ink transfer recording sheet exhibited an elongation in water of 2.45% in the cross direction of the substrate sheet.

Example 9

An aqueous resin mixture having the following composition and a solid content of 31% by weight was prepared.

| Aqueous resin mixture | |
|---|---|
| Component | Part |
| Resin: Water-dispersible polyurethane resin (trademark: ADEKABON-TITER HUX-381, made by ASAHI DENKA KOGYO K.K.) | 100 |
| Bubble stabilizer: Ammonism salt compound of higher fatty acid (trademark: F-1, made by DAINIHON INK KAGAKUKOGYO K.K.) | 5 |
| Thickener: (Urethane-modified polyether | 3 |

compound (trademark: SN THICKENER 612, made by SAN NOPKO K.K.)

The aqueous resin mixture was subjected to a bubbling (frothing) treatment by using a continuous bubbling machine (trademark: TURBOWHIP TW-70, made by AIKOSHA SEISAKUSHO) and by agitating it together with air at a revolution rate of 1500 rpm to prepare a bubbled aqueous resin mixture having a bubbling ratio of 1.9.

Immediately after the bubbling treatment, the resultant bubbled resin-containing coating liquid was coated on a front surface of a substrate sheet consisting of a woodfree paper sheet made by OJI PAPER CO., having a basis weight of 120 g/m$^2$ and usable as a support sheet of photographic printing sheet by using an applicator bar, and dried to form a porous ink-receiving layer having a dry weight of 10 g/m$^2$.

Also, the back surface of the substrate sheet opposite to the front surface on which the porous ink-receiving layer was formed, was coated with the same curl-preventing coating liquid a solid content of 5% by solid weight as in Example 1 by using a mayer bar and dried to form a curl-preventing layer having a dry weight of 10 g/m$^2$. The resultant hot melt ink transfer recording sheet was subjected to a surface-pressing treatment using the same super calender as in Example 3 under a nip pressure of 30 kg/cm at a roll peripheral speed of 5 m/min in the same manner as in Example 3. The surface-pressed hot melt ink transfer recording sheet was cut into an A4 size in such a manner that the cross direction of the substrate sheet of the recording sheet was consistant with the longitudinal direction of the A4 size sheets.

The A4 size hot melt ink transfer recording sheets exhibited an elongation in water of 2.65% in the cross direction of the substrate sheet.

Comparative Example 1

A hot melt ink transfer recording sheet was produced by the same procedures as in Example 1 with the following exceptions.

The bubbling treatment for the water-dispersible resin mixture was omitted, and the non-bubbled resin mixture was coated on a front surface of a substrate sheet consisting of a woodfree paper sheet (trademark: MARSHMALLOW, made by OJI PAPER CO.) having a basis weight of 104.7 g/m$^2$ by using an applicator bar and dried to form a non-porous ink-receiving layer having a dry weight of 10 g/m$^2$.

Also, the back surface of the substrate sheet was coated with a curl-preventing liquid having the same composition as in Example 1 and a solid content of 5% by weight by using a mayer bar, to form a curl-preventing layer having a dry weight of 3 g/m$^2$.

The resultant hot melt ink transfer recording sheet exhibited an elongation in water of 1.8% in the cross direction of the substrate sheet.

Comparative Example 2

The same hot melt ink transfer recording sheet as in Comparative Example 1 was subjected to a surface-pressing treatment using the same super calender as in Example 3 under a nip pressure of 50 kg/cm at a roll peripheral speed of 5 m/min.

The calendered hot melt ink transfer recording sheet exhibited an elongation in water of 1.80% in the cross direction of the substrate sheet.

Comparative Example 3

An aqueous resin mixture having the same composition and solid content as in Example 1 was subjected to a bubbling treatment by using the same bubbling machine as in Example 1, at a revolution rate of 300 rpm for agitation, to provide a bubbled aqueous coating liquid having a bubbling ratio of 2.0.

Immediately after the bubbling treatment, the resultant bubbled coating liquid was coated on a front surface of a substrate sheet consisting of a woodfree paper sheet (trademark: MARSHMALLOW, made by OJI PAPER CO.) having a basis weight of 104.7 gIm$^2$ by using an applicator bar and dried to form a non-porous ink-receiving layer having a dry weight of 10 g/m$^2$.

Also, the back surface of the substrate sheet was coated with a curl-preventing liquid having the same composition as in Example 1 and a solid content of 5% by weight by using a mayer bar, to form a curl-preventing layer having a dry weight of 3 g/m$^2$.

The hot melt ink transfer recording sheet was subjected to a surface-pressing treatment using the same super calender as in Example 3 under a nip pressure of 30 kg/cm at a roll peripheral speed of 5 m/min.

The calendered hot melt ink transfer recording sheet exhibited an elongation in water of 1.85% in the cross direction of the substrate sheet.

Comparative Example 4

The same non-surface-pressed hot melt ink transfer recording sheet as in Example 3 was employed as a recording sheet for a hot melt ink transfer printer. This recording sheet exhibited an elongation in water of 1.95% in the cross direction of the substrate sheet.

Comparative Example 5

The same non-surface-pressed hot melt ink transfer recording sheet as in Example 3 was subjected to a surface-pressing treatment using the same super calender as in Example 3 under a nip pressure of 15 kg/cm at a roll peripheral speed of 5 m/min.

The resultant surface-pressed hot melt ink transfer recording sheet exhibited an elongation in water of 1.95% in the cross direction of the substrate sheet.

Comparative Example 6

An aqueous resin mixture having the same composition and solid content as in Example 1 was subjected to a bubbling treatment by using the same bubbling machine as in Example 1, to provide a bubbled aqueous coating liquid having a bubbling ratio of 7.0.

Immediately after the bubbling treatment, the resultant bubbled coating liquid was coated on a front surface of a substrate sheet consisting of a woodfree paper sheet (trademark: MARSHMALLOW, made by OJI PAPER CO.) having a basis weight of 104.7 g/m$^2$ by using an applicator bar and dried to form a non-porous ink-receiving layer having a dry weight of 10 g/m$^2$.

Also, the back surface of the substrate sheet was coated with a curl-preventing liquid having the same composition as in Example 1 and a solid content of 5% by weight by using a mayer bar, to form a curl-preventing layer having a dry weight of 10 g/m$^2$.

The calendered hot melt ink transfer recording sheet exhibited an elongation in water of 2.00% in the cross direction of the substrate sheet.

Comparative Example 7

An aqueous resin mixture having the same composition and solid content as in Example 1 was subjected to a bubbling treatment by using the same bubbling machine as in Example 1, to provide a bubbled aqueous coating liquid having a bubbling ratio of 7.0.

Immediate after the bubbling treatment, the resultant bubbled coating liquid was coated on a front surface of a substrate sheet consisting of a woodfree paper sheet (trademark: MARSHMALLOW, made by OJI PAPER CO.) having a basis weight of 104.7 g/m$^2$ by using an applicator bar and dried to form a non-porous ink-receiving layer having a dry weight of 10 g/m$^2$.

Also, the back surface of the substrate sheet was coated with a curl-preventing liquid having the same composition as in Example 1 and a solid content of 5% by weight by using a mayer bar, to form a curl-preventing layer having a dry weight of 5 g/m$^2$.

The hot melt ink transfer recording sheet was subjected to a surface-pressing treatment using the same super calender as in Example 3 under a nip pressure of 40 kg/cm at a roll peripheral speed of 5 m/min.

The calendered hot melt ink transfer recording sheet exhibited an elongation in water of 2.00% in the cross direction of the substrate sheet.

Comparative Example 8

The same hot melt ink transfer recording sheet as in Example 9 was cut into a A4 size in such a manner that the cross direction of the substrate sheet of the recording sheet consisted with the transverse direction of the A4 size recording sheet.

The A4 size hot melt ink transfer recording sheets exhibited an elongation in water of 2.65% in the cross direction of the substrate sheet.

Test and Evaluation

In each of Examples 1 to 9 and Comparative Examples 1 to 8, the bubbling ratio of the bubbled resin-containing coating liquid and the properties of the resultant hot melt ink transfer recording sheet were tested and evaluated as follows.

(1) Elongation in water

The elongation in water of the ink transfer recording sheet was determined by the following test.

The recording sheet was cut into specimens having a length in the cross-direction of 150 mm and a width in the machine direction of 30 mm. The specimen was set in a symmetrical exchange type expansion and contraction tester (made by OJI KOEI K.K.) and was moisture conditioned under the conditions of 20° C.±2° C. and (65±2) % r.h. In accordance with JIS P 8111 to control the moisture content of the specimen to 0.25% or less.

Namely, the specimens set in the tester was left to stand at a temperature at a relative humidity (RH) of 65% for one hour to place the specimens in a standard dimensional condition. The length of specimens in the cross direction was measured under a load corresponding to ¼ of the basis weight of the specimens. Then, the specimens set in the tester were immersed in water at a temperature of 20° C. for 20 minutes and then the length of the water immersed specimens in the cross direction was measured in the same manner as mentioned above.

The elongation (%) in water of the specimens was calculated from the difference in length between the moisture-conditioned specimens and the water-immersed specimens.

(2) Bubbling ratio

The bubbling ratio was calculated by dividing a weight of a non-bubbled aqueous resin mixture in a volume of 100 ml by a weight of bubbled aqueous resin mixture in a volume of 100 ml.

(3) Average Pore Size (diameter)

The aqueous pore size (diameter) of the pores distributed in the surface portion of the porous ink-receiving layer was determined by the following test.

The surface of the porous ink-receiving layer of the hot melt ink transfer recording sheet was coated with by a gold metal deposition method using a metal deposition apparatus (trademark: IONSPUTTER E-102, made by HITACHI SEISAKUSHO), the gold-deposited surface was photographed by an optical microscope (model: BH-2, made by OLYMPUS KOGYO K.K.) at a magnification of 470. A transparent plastic film was placed on the microscopic photograph, and the contours of the pores appearing on the photograph were accurately recorded on the film with a black coloring pen. The information concerning the pore contours was optically read by a drum scanner (model: 2605 type drum scan-densitometer, made by ABE SEKKEI K.K.), and the optical information was analised by an image analysis apparatus (trademark: LUZEX III, made by NIRECO). The arithmetic average of the measured diameters (sizes) of the pores was calculated. The average pore size was represented by the calculated arithmetic average of the pore sizes. The measurement area of the specimen was 0.06 $mm^2$ (200 $\mu m \times 300\ \mu m$) for each of the examples and comparative examples. Since the contours of the pores formed in the surface portion of the porous ink-receiving layer are not always truely circular, the pore size was calculated as a diameter of a circle having an area corresponding to the area surrounded by the contour of the pore obtained by the image analysis.

(4) Apparent Density

The apparent density in $g/cm^3$ of the porous ink-receiving layer was determined by determining a difference in thickness (mm) between the hot melt ink transfer recording sheet and the substrate sheet, and by dividing the amount in $g/m^2$ of the porous ink-receiving layer by the volume in $cm^3/m^2$ of the porous ink-receiving layer per $m^2$ thereof. The thickness was measured in accordance with JIS P 8118.

It was confirmed that no change in thickness of the substrate sheet due to the surface-pressing (calendering) treatment occurred.

(5) Measurement of compressive thickness reduction of porous ink-receiving layer Each of the hot melt ink transfer recording sheets having the porous ink-receiving layers produced in Examples 1 to 9 and Comparative Examples 1 to 8 was moisture-conditioned at a temperature of 20° C. at a relative humidity (RH) of 65% for 24 hours, and then the porous ink-receiving layer formed on the substrate sheet was compressed in the direction of thickness thereof by using a strograph M-2 type tester (made by TOYO SEIKI SEISAKUSHO) at a compressing rate of 0.5 mm/min, to record a compressing stress-strain curve, and a compressed thickness reduction (deformation) of the porous ink-receiving layer generated at a compressing stress of 1.0 $kg/cm^2$ was determined. It was confirmed that the compressive thickness reduction was formed only in the porous ink-receiving layer and no deformation occurred in the substrate sheet.

(6) Recording Performance

Each of the hot melt ink transfer recording sheets having the porous ink-receiving layers produced in Examples 1 to 9 and Comparative Examples 1 to 8 was moisture-conditioned at a temperature of 20° C. at a relative humidity (RH) of 65% for 24 hours, and then subjected to a full color hot melt ink transfer printing using a thermal ink transfer printer (model: MD-1000, made by ALPS DENKI K.K.) at a degree of resolution of 1200 dpi in a gloss mode (in which, after ink image-transferring, a transparent film was brought into contact with the image-transferred surface of the recording sheet under pressure, and the images were heated by the thermal head through the transparent film to enhance the gloss of the images). The color reflection density of the transferred ink images was measured by a Macbeth reflective color density tester. Also, the qualities of transferred images in the items (i) to (iv) shown below were evaluated by the naked eye observation in the following four classes.

| Class | Image quality |
|---|---|
| 4 | Excellent |
| 3 | Satisfactory |
| 2 | Slightly unsatisfactory |
| 1 | Unsatisfactory |

(i) Color gradation reproducibility

The recording sheet was printed with cyan (C)-coloring ink images, magenta (M)-coloring ink images, yellow (Y)-coloring ink images, cyan and magenta (C+M) coloring ink-superposed images, cyan and yellow (C+Y) coloring ink-superposed images, magenta and yellow (M+Y) coloring ink-superposed images and cyan, magenta and yellow (C+M+Y) coloring ink-superposed images, in ten step color tone patterns from 10% to 100% (solid printing), and the color density of the images were measured by using a Macbeth reflective color density tester.

The maximum color density of the three (C+M+Y) coloring ink-superposed images and the gradation reproducibility of each of the single coloring ink images, the two coloring ink-superposed images and the three coloring ink-superposed images were evaluated in four classes 4 (best), 3, 2 and 1 (worst).

(ii) The Dot Reproducibility

The ink dots transferred from an ink ribbon to the ink-receiving layer were observed by the naked eye and the dot reproducibility was evaluated in four classes 4 (best), 3, 2 and 1 (worst).

(iii) Appearance of Recording Surface

The surface of the recording sheet was observed whether indents and/or defects were formed on the surface (non-printed portions and printed portions) of the recording sheet, and evaluated in four classes 4 (best), 3, 2 and 1 (worst).

(iv) Peel off of Ink-receiving Layer

The image-formed portions of the recording sheet were observed to find white spots formed due to partial peeling off of the ink-receiving layer.

(7) Dot Shift-preventing Property

Each of the hot melt ink transfer recording sheets having the porous ink-receiving layers produced in Examples 1 to 9 and Comparative Examples 1 to 8 was moisture-conditioned at a temperature of 35° C. at a relative humidity (RH) of 80% for 24 hours, and then subjected to a hot melt ink transfer printing using a thermal ink transfer printer (model: MD-5000, made by ALPS DENKI) in an image pattern in which straight lines in cyan (C) color and in magenta (M) color are located in the four corners of the recording sheet. The dot shift-preventing property of the recording sheet was evaluated by determining the deviations in position (shears) between the printed cyan-colored straight line and the printed magenta-colored straight line in each corner, by using a digital reader (model: DR-550-D, made by DAINIPPON SCREEN SEIZO K.K.), in the following four classes.

| Class | Shear in printing |
|---|---|
| 4 | No shear between the cyan and magenta-colored dots is found. |
| 3 | Shear between the cyan and magenta-colored dots is 50 μm or less. |
| 2 | Shear between the cyan and magenta-colored dots is 50 to 100 μm. |
| 1 | Shear between the cyan and magenta-colored dots is more than 100 μm. |

The test results are shown in Table 1.

TABLE 1

| Example No. | | Item: Elongation in water of substrate sheet | Bubbling ratio of coating liquid | Porous ink-receiving layer: Coating weight (g/m²) | Average pore size (μm) | Surface-pressing treatment | Apparent density (g/cm³) | Compressive thickness reduction (μm) | Hot melt ink transfer recording performance: Maximum reflection color density | Gradation reproducibility | Dot reproducibility | Recording surface appearance | Peeling off of ink-receiving layer | Dot shift-preventing property |
|---|---|---|---|---|---|---|---|---|---|---|---|---|---|---|
| Example | 1 | 1.80 | 1.2 | 10 | 25.0 | None | 0.85 | 5 | 1.52 | 3 | 3 | 4 | None | 3 |
| | 2 | 0 | 2.4 | 10 | 15.0 | None | 0.42 | 10 | 1.50 | 3 | 3 | 4 | None | 4 |
| | 3 | 1.95 | 3.0 | 10 | 5.0 | Applied | 0.53 | 8 | 1.55 | 4 | 4 | 4 | None | 3 |
| | 4 | 1.95 | 3.0 | 10 | 5.0 | Applied | 0.83 | 6 | 1.53 | 4 | 4 | 4 | None | 3 |
| | 5 Front side | 1.90 | 3.0 | 10 | 5.0 | Applied | 0.60 | 7 | 1.51 | 4 | 4 | 4 | None | 3 |
| | Back side | 1.90 | 3.0 | 10 | 5.0 | Applied | 0.61 | 7 | 1.51 | 4 | 4 | 4 | None | 3 |
| | 6 | 2.00 | 6.0 | 10 | 4.5 | Applied | 0.40 | 10 | 1.56 | 4 | 4 | 3 | None | 3 |
| | 7 | 1.35 | 3.0 | 10 | 5.0 | Applied | 0.50 | 7 | 1.55 | 4 | 4 | 4 | None | 4 |
| | 8 | 2.45 | 3.0 | 10 | 5.0 | Applied | 0.51 | 8 | 1.54 | 4 | 4 | 4 | None | 3 |
| | 9 | 2.65 | 1.9 | 10 | 6.0 | Applied | 0.55 | 7 | 1.53 | 4 | 4 | 4 | None | 4 |
| Comparative Example | 1 | 1.80 | 1.0 | 10 | — | None | 1.11 | 3 | 1.49 | 1 | 1 | 3 | None | 3 |
| | 2 | 1.80 | 1.0 | 10 | — | Applied | 1.30 | 2 | 1.60 | 2 | 2 | 3 | None | 3 |
| | 3 | 1.85 | 2.0 | 10 | 35.5 | Applied | 0.66 | 7 | 1.39 | 1 | 1 | 3 | None | 3 |
| | 4 | 1.95 | 3.0 | 10 | 5.0 | None | 0.24 | 18 | 1.59 | 4 | 4 | 1 | None | 3 |
| | 5 | 1.95 | 3.0 | 10 | 5.0 | Applied | 0.34 | 14 | 1.5O | 4 | 4 | 2 | None | 3 |
| | 6 | 2.00 | 7.0 | 10 | 4.2 | None | 0.12 | 28 | 1.60 | 4 | 4 | 1 | Occurred | 3 |
| | 7 | 2.00 | 7.0 | 10 | 4.2 | Applied | 0.56 | 8 | 1.56 | 4 | 4 | 4 | Occurred | 3 |
| | 8 | 2.65 | 1.9 | 10 | 6.0 | Applied | 0.56 | 7 | 1.54 | 4 | 4 | 4 | None | 1 |

As Table 1 clearly shows, the hot melt ink transfer recording sheet of the present invention prepared in Examples 1 to 9 had extent color density, color gradation reproducibility and dot reproducibility of the recorded ink images, a satisfactory appearance of the recording surface, a high resistance to peeling off of ink-receiving layer, and an enhanced dot shear-preventing property.

In Comparative Example 1 in which the bubbling treatment for the resin-containing coating liquid was omitted while the resultant recording sheet exhibited the similar color density of the images, the appearance of the recording surface and the resistance to peeling off of the ink-receiving layer to those of the present invention, the color gradation reproducibility and dot reproducibility in the ink images thereof were unsatisfactory. Also, in Comparative Example 1, when the resultant hot melt ink transfer recording sheet was subjected to a surface-pressing (calendering) treatment as shown in Comparative Examples 2, while the smoothness of the porous ink-receiving layer was improved by the surface-pressing treatment and the color density of the recorded images was enhanced, the color gradation reproducibility and the dot reproducibility of the images could not reach a satisfactory level.

As shown in Comparative Example 3, even when the apparent density of the porous ink-receiving layer is appropriate, when the average pore size of the pores distributed in the surface portion of the porous ink-receiving layer is 35.5 μm, which is too large, the color density of the recorded ink images was unsatisfactory, and the color gradation reproducibility and the dot reproducibility of the images were insufficient. The reasons for these disadvantageous properties are assumed to be that the transferred ink is embedded within the pores in the porous ink-receiving layer.

As shown in Comparative Example 4, the hot melt ink transfer recording sheet which was produced by using a bubbled resin-containing coating liquid having a bubbling ratio of 3.0 and without applying a surface pressing treatment thereto and thus which has a low apparent density, exhibited very good color density, color gradation reproducibility, and dot reproducibility of the ink images, due to the fact that the porous ink-receiving layer exhibited good performance. However, this recording sheet was disadvantageous in that the porous ink-receiving layer was density deformed and thus indents or stripes are easily formed on the recording sheet so as to degrade the appearance of the recording sheet.

Also, when the enhancement of the apparent density of the porous ink-receiving layer by the surface-pressing treatment is insufficient as shown in Comparative Example 5, the improvement of the appearance of the recording surface was insufficient.

As shown in Comparative Example 6, the hot melt ink-transfer recording sheet having a porous ink-receiving layer with a low apparent density had good color density, color gradation reproducibility and dot reproducibility of the printed ink images. However, this recording sheet had a recording surface having a very bad appearance and the recorded ink images contained inkless white spots. This phenomenon was derived from the fact that since the bubbled resin-containing coating liquid having a bubbling ratio of 7.0 was used, the resin walls surrounding the pores contained in the porous ink-receiving layer are thin, and thus the resultant ink-receiving layer exhibited a reduced mechanical strength, and therefore, when the hot melt ink is transferred from the ink ribbon to the ink-receiving layer and the ink ribbon is separated from the ink-receiving layer portions of the ink receiving layer are broken and peeled off from the substrate sheet so as to form white spots in the ink images.

Also, as shown in Comparative Example 7, when the apparent density of the porous ink-receiving layer is enhanced by applying the surface-pressing treatment to the hot melt ink transfer recording sheet, while the appearance of the porous ink-receiving layer was improved, the mechanical strength of the porous ink-receiving layer was insufficient and thus the formation of the white spot in the transferred ink images could not be satisfactory prevented.

As shown in Comparative Example 8, when the resultant hot melt ink transfer recording sheet exhibited a high elongation in water in the cross direction of the substrate sheet, and cut into a A4 size in such a manner that the cross direction of the substrate sheet was consistant with the longitudinal direction of the A4 size recording sheets, since the transfer of the first coloring ink to the recording sheet cases the recording sheet to be elongated in the scanning direction of the thermal head, the second coloring ink and other succeeding coloring inks could not be accurately superposed on the first coloring ink images, and shears of ink dots occur. Therefore, highly accurate images having a desired color could not be obtained. The hot melt ink transfer recording sheet of the present invention and the process for producing the same are advantageous in that when the recording sheet is employed in a hot melt ink transfer printer in which a thermal head is brought into contact with the recording sheet through an ink ribbon under a high contact pressure, the resultant printed product has ink images having a high color density, a good color gradation reproducibility, and a good dot reproducibility; the image recorded surface are free form indents and stripes and had an excellent appearance; and the shear in printed ink dots is very small. Therefore, the hot melt ink transfer recording sheet of the present invention is very useful for practice and can be employed in various industries.

What is claimed is:

1. A hot melt ink transfer recording sheet comprising:

a substrate sheet; and a porous ink-receiving layer formed on at least one surface of the substrate sheet by coating a resin-containing coating liquid comprising, as a principal component, a water-dispersible resin, the porous ink-receiving layer having an average pore size of the pores distributed in the surface portion thereof of 0.5 to 30 $\mu$m an apparent density of 0.81 to 0.9 g/cm$^3$, and a compressive thickness reduction of 10 $\mu$m or less upon applying a compressive pressure of 1.0 kg/cm$^2$ to the porous ink-receiving layer surface in the direction of the thickness of the porous ink-receiving layer.

2. The hot melt ink transfer recording sheet as claimed in claim 1, wherein the apparent density of the porous ink-receiving layer is controlled to a level of from 0.4 to 0.9 g/cm$^3$ by applying a pressure surface treatment to the hot melt ink transfer recording sheet.

3. The hot melt ink transfer recording sheet as claimed in claim 1 or 2, wherein an elongation of the hot melt ink transfer recording sheet in the cross direction thereof upon immersing it in water for 20 minutes in accordance with J. TAPPI No. 27 is 2.5% or less.

4. The hot melt ink transfer recording sheet as claimed in claim 1, wherein the substrate sheet comprises a paper sheet comprising, as a principal component, cellulose.

5. The hot melt ink transfer recording sheet as claimed in claim 1, wherein the water-dispersible resin for the porous ink-receiving layer comprises at least one member selected from water-dispersible polyurethane, urethane-acrylate ester copolymer, styrene-butadiene copolymer, acrylonitrile-butadiene copolymer, methyl ethacrylate-butadiene copolymer, styrene-acrylate ester copolymer, polyacrylate ester, polymethacrylate ester, polyvinyl acetate, vinyl chloride-vinyl acetate copolymer, ethylene-vinyl acetate and polyvinylidene chloride resins.

6. A process for producing a hot metal ink transfer recording sheet, comprising:

mechanically agitating a coating liquid containing a polymeric material to an extent such that a large number of fine air bubbles independent from each other are introduced into the coating liquid in a bubbling ratio in volume of the bubbled coating liquid to the non-bubbled coating liquid of 1.1 or more but less than 2.5;

coating at least one surface of a substrate sheet with the bubbled coating liquid; and drying the coated bubbled coating liquid layer, to thereby form a porous ink-receiving layer having an average pore size of 0.5 to 30 $\mu$m of the pores distributed in the surface portion of the porous ink-receiving layer, an apparent density of 0.4 to 0.9 g/cm$^3$, and a compressive thickness reduction of 10 $\mu$m or less upon applying a compressive pressure of 1.0 kg/cm$^2$ onto the porous ink-receiving layer surface in the direction of the thickness of the porous ink-receiving layer.

7. A process for producing a hot melt ink transfer recording sheet, comprising:

mechanically agitating a coating liquid containing a polymeric material to an extent such that a large number of fine air bubbles independent from each other are introduced into the coating liquid in a bubbling ratio in volume of the bubbled coating liquid to the non-bubbled coating liquid of 2.5 to 6.0;

coating at least one surface of a substrate sheet with the bubbled coating liquid;

drying the coated bubbled coating liquid layer; and applying a surface-pressing treatment to the porous ink-receiving layer surface, to thereby form a porous ink-receiving layer having an average pore size of 0.5 to 30 $\mu$m of the pores distributed in the surface portion of the porous ink-receiving layer, an apparent density of 0.4 to 0.9 g/cm$^3$, and a compressive thickness reduction of 10 $\mu$m or less upon applying a compressive pressure of 1.0 kg/cm$^2$ onto the porous ink-receiving layer surface in the direction of the thickness of the porous ink-receiving layer.

* * * * *

UNITED STATES PATENT AND TRADEMARK OFFICE

CERTIFICATE OF CORRECTION

PATENT NO. : 6,261,670 B1
DATED : July 17, 2001
INVENTOR(S) : Hakomori et al.

It is certified that error appears in the above-identified patent and that said Letters Patent is hereby corrected as shown below:

Column 29,
Line 59, change "0.81" to -- 0.51 --.

Signed and Sealed this

Twenty-third Day of April, 2002

*Attest:*

*Attesting Officer*

JAMES E. ROGAN
*Director of the United States Patent and Trademark Office*